US005100310A

United States Patent [19]

Uppal

[11] Patent Number: 5,100,310

[45] Date of Patent: Mar. 31, 1992

[54] GEROTOR MOTOR AND IMPROVED VALVE DRIVE THEREFOR

[75] Inventor: Sohan L. Uppal, Bloomington, Minn.

[73] Assignee: Eaton Corporation, Cleveland, Ohio

[21] Appl. No.: 633,876

[22] Filed: Dec. 26, 1990

[51] Int. Cl.[5] ..... F01C 1/10; F03C 2/08

[52] U.S. Cl. ..... 418/61.3

[58] Field of Search ..... 418/61.3

[56] References Cited

U.S. PATENT DOCUMENTS

| | | | |
|---|---|---|---|
| 3,309,999 | 3/1967 | Patterson, Jr. | 418/61.3 |
| 4,171,938 | 10/1979 | Pahl | 418/61.3 |
| 4,449,898 | 5/1984 | Lambeck | 418/61.3 |
| 4,451,217 | 5/1984 | White | 418/61.3 |
| 4,877,383 | 10/1989 | White, Jr. | 418/61.3 |
| 4,981,423 | 1/1991 | Bissonnette | 418/61.3 |

*Primary Examiner*—John J. Vrablik
*Attorney, Agent, or Firm*—L. J. Kasper

[57] ABSTRACT

A rotary fluid pressure device is disclosed of the type including a gerotor displacement mechanism (17). The gerotor includes a ring member (21) and a star member (23) eccentrically disposed within the ring member, and having relative orbital and rotational movement therein. The device includes a spool valve member (51) disposed immediately adjacent the gerotor and adapted to be rotated at the speed of rotation of the star member. The device further includes an output shaft (29). Orbital and rotational movement of the star member is transmitted to the output shaft by means of an elongated, hollow, universal shaft (69). A valve drive shaft (79) is located at least partially within, and extending axially through the hollow universal shaft. In one embodiment of the invention, the valve drive shaft includes a valve end (85) in engagement with the spool valve, and a shaft end (81) in engagement with the output shaft, to transmit rotation of the output shaft into rotation of the spool valve (51).

15 Claims, 4 Drawing Sheets

GEROTOR MOTOR AND IMPROVED VALVE DRIVE THEREFOR

BACKGROUND OF THE DISCLOSURE

The present invention relates to rotary fluid pressure devices such as low-speed, high-torque gerotor motors, and more particularly, to a novel valve drive arrangement for such motors.

Low-speed, high-torque gerotor motors of the type to which the present invention relates are typically classified, in regard to their method of valving, as being either "spool valve" motors, or "disc valve" motors. As used herein, the term "spool valve" refers to a generally cylindrical valve member in which the valving action occurs between the cylindrical outer surface of the spool valve, and the adjacent, internal cylindrical surface of the surrounding housing. The term "disc valve" refers to a valve member which is generally disc-shaped, and the valving action occurs between a transverse surface (perpendicular to the axis of rotation) of the disc valve and an adjacent transverse surface.

Although the present invention may be utilized with either a spool valve or a disc valve gerotor motor, it is especially advantageous when used with a spool valve motor, and will be described in connection therewith.

Spool valve designs are especially well suited for use with relatively smaller gerotor motors, especially where it is desired to minimize the transverse cross-sectional configuration of the motor. The configuration of the spool valve motor which is the most common, commercially, is one in which the spool valve is formed integral with the output shaft and therefore, is located "forwardly" of the gerotor. One disadvantage of this particular configuration is that the spool valve necessarily has a fairly thin wall, and pressures in the range of 2,000 PSI can cause sufficient radial shrinkage of the spool valve to diminish the volumetric efficiency of the motor.

Another configuration which is known is to locate the spool valve "rearwardly" of the gerotor, but substantially increase the wall thickness of the spool to avoid the radial shrinkage problem and the resulting reduction in volumetric efficiency. However, in such a configuration, the methods for transmitting orbital and rotational movement of the gerotor star into rotational movement of the spool valve which are known in the prior art, result in either substantial complication of the motor design, or an increase in the axial length of the motor.

SUMMARY OF THE INVENTION

Accordingly, it is an object of the present invention to provide an improved gerotor motor design which is more compact, and better suited for use in a relatively smaller motor.

It is a more specific object of the present invention to provide an improved gerotor motor in which the means for transmitting rotational motion from the gerotor star to the rotary valve member does not add to the overall length of the gerotor motor design.

It is a related object of the present invention to provide an improved gerotor motor design which facilitates the use of a roller gerotor as the displacement mechanism in a small motor, in view of the fact that a roller gerotor provides especially good performance at low speeds, and under start-stop conditions.

The above and other objects of the present invention are accomplished by the provision of a rotary fluid pressure device of the type including housing means defining fluid inlet and fluid outlet means, and a fluid energy translating displacement means associated with the housing means, including an internally-toothed ring member and an externally-toothed star member eccentrically disposed within the ring member. The star member has orbital and rotational movement relative to the ring member, the teeth of the ring and star members interengaging to define expanding and contracting fluid volume chambers in response to the orbital and rotational movement. A valve means cooperates with the housing means to provide fluid communication between the inlet means and the expanding volume chambers, and between the contracting volume chambers and the outlet means. An input-output shaft means is included, and means for transmitting the rotational movement of the star member to the input-output shaft means. The valve means comprises a valve member adapted to be rotated at the speed of rotation of the star member, and being disposed on the side of the displacement means opposite the input-output shaft means.

The device is characterized by the means for transmitting the rotational movement of the star member comprising an elongated, hollow, universal shaft operable to transmit the orbital and rotational movement of the star member into rotational movement of the input-output shaft means. A valve drive shaft is located partially within, and extending axially through, the hollow universal shaft, the valve drive shaft including a valve end in engagement with the valve member, and a shaft end in engagement with a portion of a member, wherein said portion has purely rotational motion, to transmit said rotational motion into rotation of the valve member.

DESCRIPTION OF THE PREFERRED EMBODIMENTS

Figure 1:
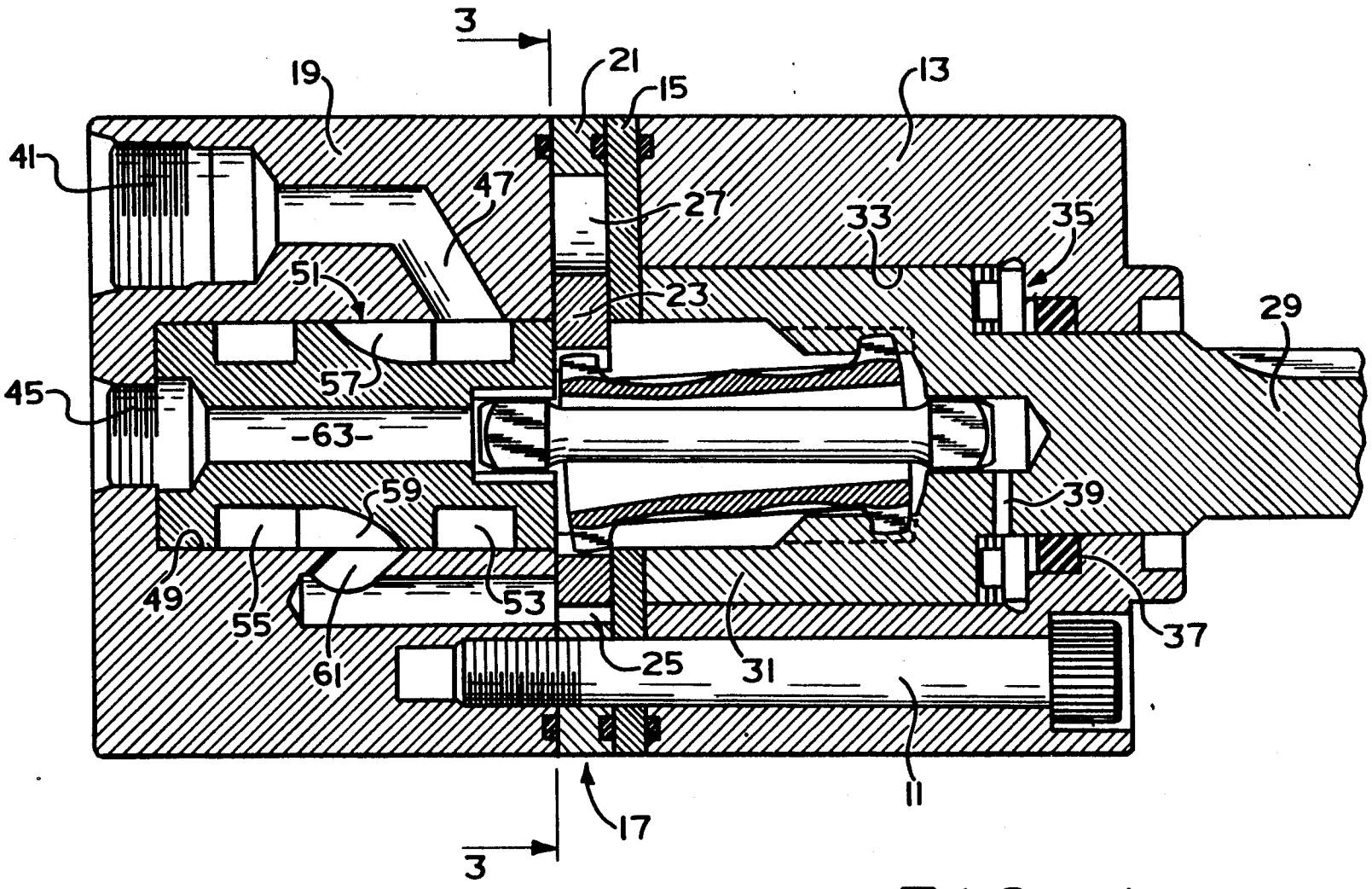
FIG. 1 is an axial cross-section of a low-speed, high-torque gerotor motor made in accordance with the present invention.
Figure 3:
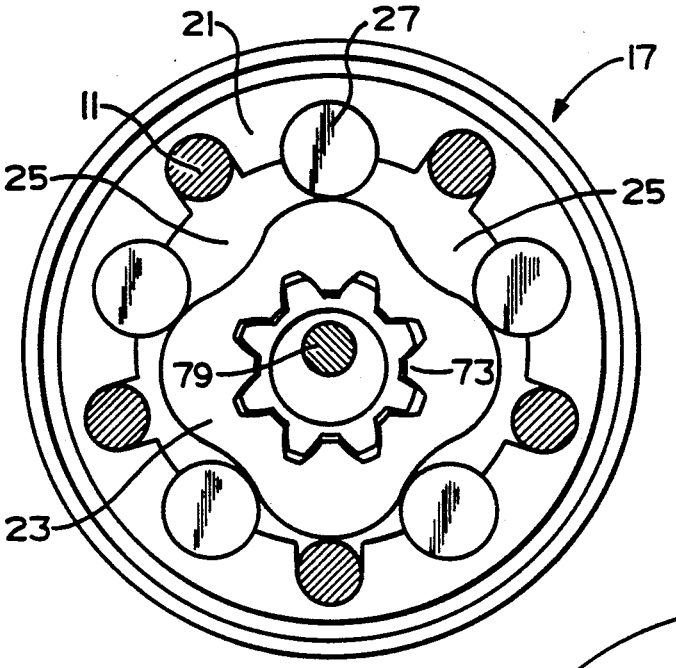
FIG. 3 is a transverse cross-section taken on line 3—3 of FIG. 1, but on a somewhat smaller scale.

Referring now to the drawings, which are not intended to limit the invention, FIG. 1 illustrates a low-speed, high-torque gerotor motor made in accordance with the present invention, and which is especially adapted for use as a "mini-motor", i.e., one which is relatively small in overall dimensions. The gerotor motor shown in FIG. 1 comprises a plurality of sections secured together, such as by a plurality of bolts 11. The motor includes a shaft support casing 13, a wear plate 15, a gerotor displacement mechanism 17, and a valve housing section 19.

The gerotor mechanism 17 is well known in the art, is shown and described in U.S. Pat. No. 4,533,302, assigned to the assignee of the present invention, and will be described only briefly herein. More specifically, the gerotor mechanism 17 comprises an internally-toothed ring member 21 and an externally-toothed star member 23, eccentrically disposed within the ring member 21. The star member 23, in the subject embodiment, orbits and rotates relative to the ring member 21, and this orbital and rotational movement defines a plurality of expanding and contracting fluid volume chambers 25. Although not an essential feature of the present invention, it is considered preferable for the ring member 21 to include a plurality of generally cylindrical rollers 27, which comprise the internal teeth of the ring member 21.

Referring still primarily to FIG. 1, the motor includes an output shaft 29, rotatably supported within the shaft support casing 13. It should be clearly understood that if the device is to be used as a pump, the shaft 29 can instead serve as an input shaft. Formed integrally with the output shaft 29 is a generally cylindrical portion 31, journalled within a bore 33 defined by the shaft support casing 13. Disposed adjacent a forward shoulder of the cylindrical portion 31 is a thrust bearing assembly 35, and adjacent thereto is a shaft seal assembly 37, disposed between the output shaft 29 and the shaft support casing 13. The thrust bearing assembly receives lubricant fluid by means of a radial bore 39 drilled in the output shaft 29.

Figure 2:
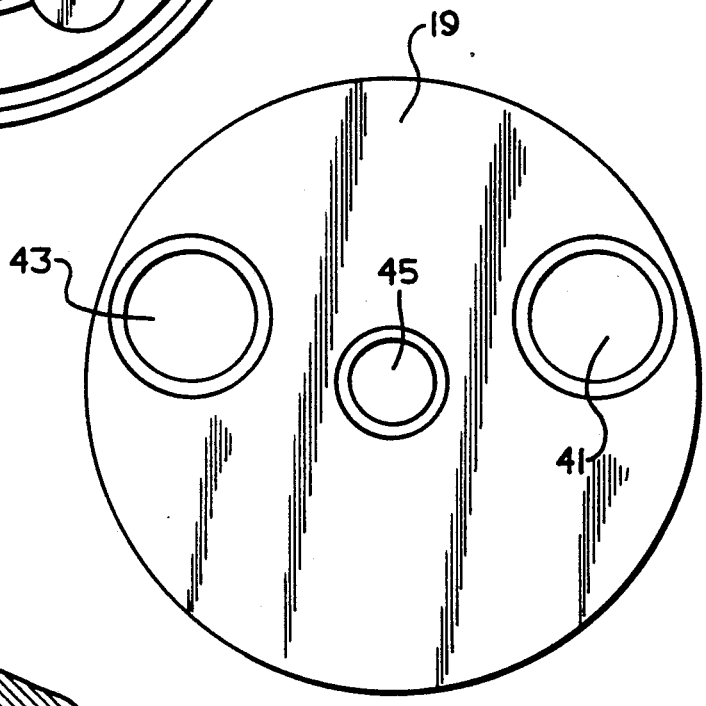
FIG. 2 is an end plan view of the left end of the motor of FIG. 1.

Referring now primarily to FIGS. 1 and 2, the valve housing section 19 defines an inlet port 41, an outlet port 43 (shown only in FIG. 2), and a case drain port 45. The valve housing 19 defines a pressure passage 47 extending from the inlet port 41 to a valve bore 49 defined by the housing section 19. Rotatably disposed within the valve bore 49 is a spool valve member 51. As is generally well known to those skilled in the art, the spool valve member 51 defines a forward circumferential groove 53 in communication with the inlet port 41 by means of the pressure passage 47 and a rearward circumferential groove 55, in fluid communication with the outlet port 43 by means of a passage (not shown in FIG. 1). The spool valve 51 further defines a plurality of forward axial slots 57, in communication with the forward groove 53, and a plurality of rearward axial slots 59 in communication with the rearward groove 55. The axial slots 57 and 59 are arranged in an alternating interdigitated pattern about the outer periphery of the spool valve 51. The valve housing section 19 defines a plurality of commutation passages 61, each of which is in open communication with one of the fluid volume chambers 25. Therefore, in the subject embodiment, because there are five of the volume chambers 25, there are five of the commutation passages 61, four of the forward axial slots 57, and four of the rearward axial slots 59, for reasons which are well known to those skilled in the art.

Referring still primarily to FIG. 1, the present invention is especially suited for use in a motor in which the spool valve 51 is relatively solid, i.e., having sufficient radial thickness that operation of the motor at some predetermined pressure level will not cause substantial collapse of the spool. It will be understood that, as used herein, the term "collapse" refers to a decrease in the outer diameter of the spool valve 51, sufficient to permit substantial leakage of fluid between the valve bore 49 and the outer surface of the spool valve 51, thus reducing the volumetric efficiency of the device. The spool valve 51 defines an axial passage 63, but the spool valve 51 is still considered "relatively solid" because the diameter of the axial passage 63 is selected, relative to the predetermined pressure at which the motor will operate, such that no substantial collapse of the spool valve 51 will occur. The primary function of the axial passage 63 is to communicate leakage fluid from anywhere in the interior (case drain region) of the motor to the case drain port 45. See co-pending application U.S. Ser. No. 342,424, filed Apr. 24, 1989, now U.S. Pat. No. 4,992,034, in the name of Sohan L. Uppal for a "Low-Speed, High-Torque Gerotor Motor And Improved Valving Therefor".

Figure 4:
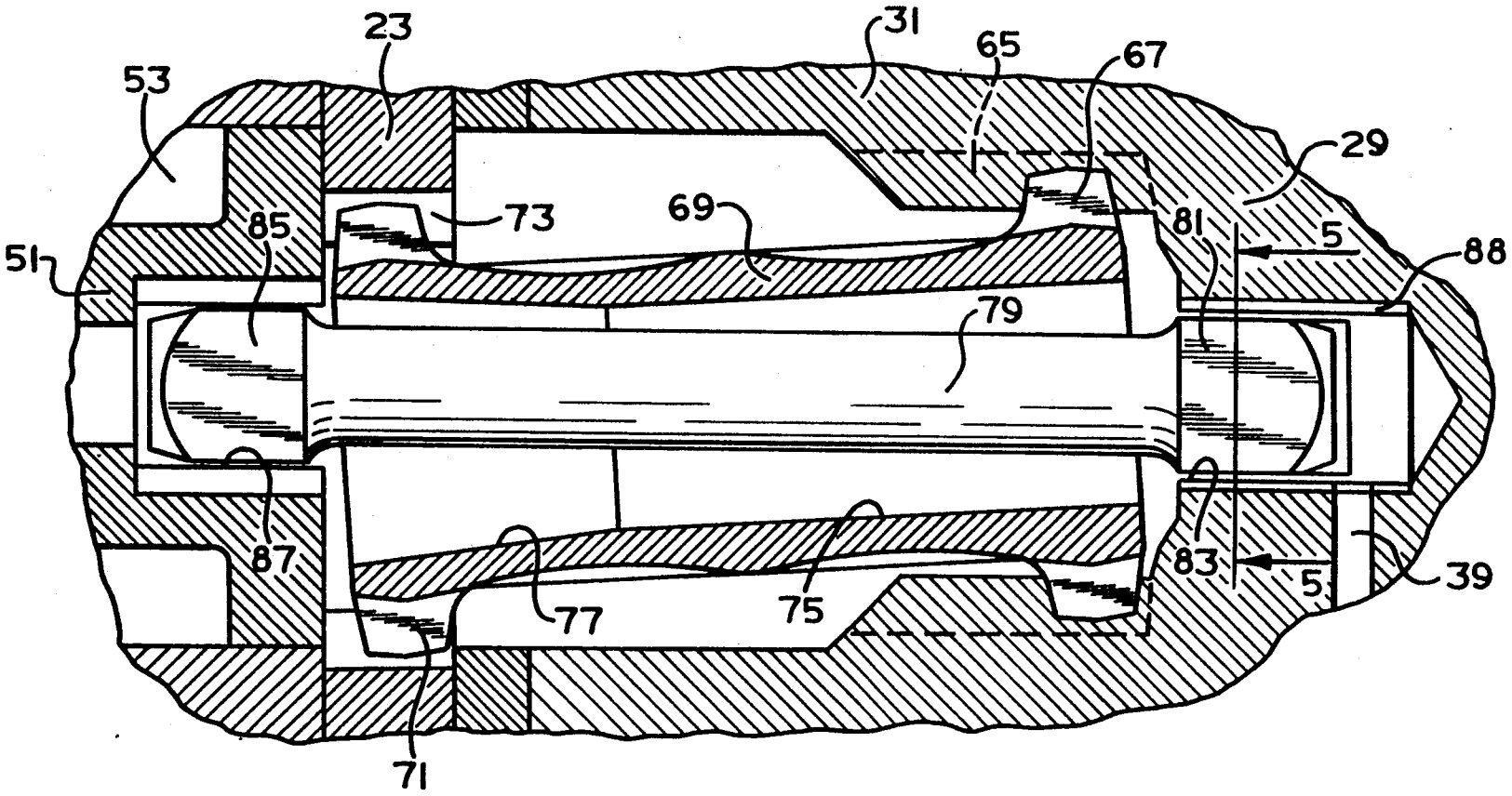
FIG. 4 is an enlarged, fragmentary, axial cross-section, similar to FIG. 1, illustrating the valve drive arrangement of the present invention.

Referring now to FIG. 4, in conjunction with FIG. 1, the valve drive arrangement of the present invention will be described. The cylindrical portion 31 of the output shaft 29 includes a set of internal, straight splines 65, and in engagement therewith is a set of external, crowned splines 67, formed on the forward end of a main drive shaft 69, which serves as a "universal" shaft. As is used herein, the term "universal" in reference to the main drive shaft 69 means a shaft which is able to transmit orbital and rotational movement into only rotational movement, or vice-versa. Disposed at the rearward end of the main drive shaft 69 is another set of external, crowned splines 71, in engagement with a set of internal, straight splines 73, formed about the inside of the star 23. In the subject embodiment, the ring member 21 includes five of the rollers 27 (internal teeth) and the star member 23 includes four external teeth. Therefore, four orbits of the star 23 result in one complete rotation thereof, and one complete rotation of the main drive shaft 69 and the output shaft 29.

It is an important aspect of the present invention to provide a valve drive arrangement for transmitting rotational movement from the star 23 and the output shaft 29 to the spool valve 51. It is also an important aspect of the present invention to provide an arrangement for transmitting such rotational motion when the spool valve 51 is disposed immediately adjacent the gerotor 17. It is another important aspect of the present invention to provide an arrangement for transmitting such rotational motion when the spool valve 51 is disposed on the side of the gerotor 17 opposite the output shaft 29. As may best be seen in FIG. 4, with the particular design of the subject embodiment, there is very little room, either axially or radially, to provide a means to transmit rotational motion from an orbiting and rotating star member 23 to the spool valve 51, using any of the conventional valve drive arrangements well known in the prior art.

In accordance with the present invention, the main drive shaft 69 comprises an elongated, hollow member defining a generally cylindrical bore portion 75, and a tapered bore portion 77, the function of which will be described subsequently. The drive shaft 69 is hollow to accommodate a valve drive shaft, generally designated 79, which is received within the bore portions 75 and 77 of the drive shaft 69, but extends axially beyond the drive shaft 69, both forwardly (to the right in FIGS. 1 and 4) and rearwardly (to the left in FIGS. 1 and 4).

The valve drive shaft 79 includes a forward shaft end 81 received within an opening 83 defined by the output shaft 29. Similarly, the valve drive shaft 79 includes a rearward valve end 85, which is received within an opening 87 formed in the spool valve 51.

Figure 5:
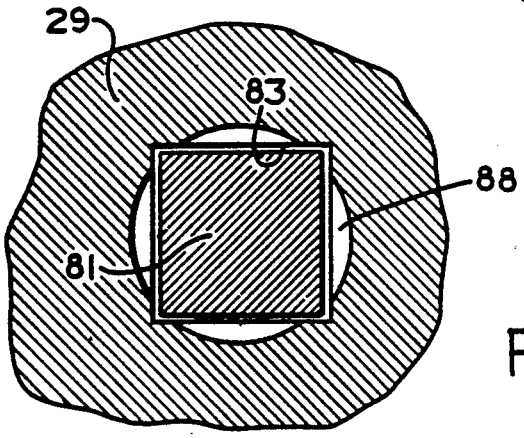
FIG. 5 is a transverse cross-section taken on line 5—5 of FIG. 4, and on the same scale as FIG. 4.

Referring now primarily to FIG. 5, the shaft end 81 of the valve drive shaft 79 is illustrated, by way of example only, as being substantially square in cross-section, with the opening 83 also being square, the shaft end 81 being closely fitted within the opening 83. In the subject embodiment, the opening 83 also includes four arcuate oil passages 88, to permit communication of lubrication fluid from the case drain region, past the shaft end 81, and through the bore 39 to the bearings 35.

For ease of manufacture, the valve end 85 may have the same configuration and cross-section as the shaft end 81, although such is not an essential feature of the present invention. Although the cross-section of the shaft end 81 is illustrated herein as being square, it will be apparent to those skilled in the art that various other configurations could be utilized, and it is intended that any such configuration be within the scope of the invention, as long as the configuration is able to perform the desired function, i.e., transmit the rotational motion of the output shaft 29 (and a relatively small amount of torque) to the spool valve 51. Preferably, the openings 83 and 87 have substantially the same transverse, cross-sectional configuration, and the shaft end 81 and valve end 85 also have substantially the same transverse, cross-sectional configuration. If such is the case, the valve drive shaft 79 is "reversible", i.e., either end of shaft 79 may be inserted in either of the openings 83 or 87, thus simplifying assembly of the device.

It is also important that the fit between the shaft end 81 and its opening 83, and between the valve end 85 and its opening 87 be sufficiently close and accurate such that one revolution of the output shaft 29 results in substantially one revolution of the spool valve 51, within reasonable manufacturing tolerances. In FIGS. 1 and 4, the clearances between the shaft end 81 and its opening 83, and between the valve end 85 and its opening 87, are exaggerated for ease of illustration. As is well known to those skilled in the art, it is important to have correct "timing", i.e., the relative rotational position of the spool valve 51 and the star 23. If the timing is somewhat inaccurate, as a result of wear, or "wind-up" of a shaft, the volumetric efficiency of the motor may be seriously affected.

Referring still to FIG. 4, it may be seen that the valve drive arrangement of the present invention is ideal for use in a relatively small, compact motor because the drive from the output shaft 29 to the spool valve 51 is accomplished solely by means of elements which are disposed concentric with the axis of rotation of the shaft 29 and valve 51, rather than by means of elements which are eccentrically disposed, and would therefore require a greater amount of space in the radial direction. It is also a particular advantage of the present invention that the drive from the star member 23 to the spool valve 51 does not require the inclusion of any elements which add to the axial length of the motor design, or which prevent the spool valve 51 from being disposed immediately adjacent the star member 23.

It should be noted that the forward end of the main drive shaft 69 engages in purely rotational motion, and therefore, the bore portion 75 can be generally cylindrical. However, because the rearward end of the drive shaft 69 engages in a combination of orbital and rotational motions, the bore portion 77 is preferably tapered to prevent interference between the main drive shaft 69 and the valve drive shaft 79.

ALTERNATIVE EMBODIMENTS

Figure 6:
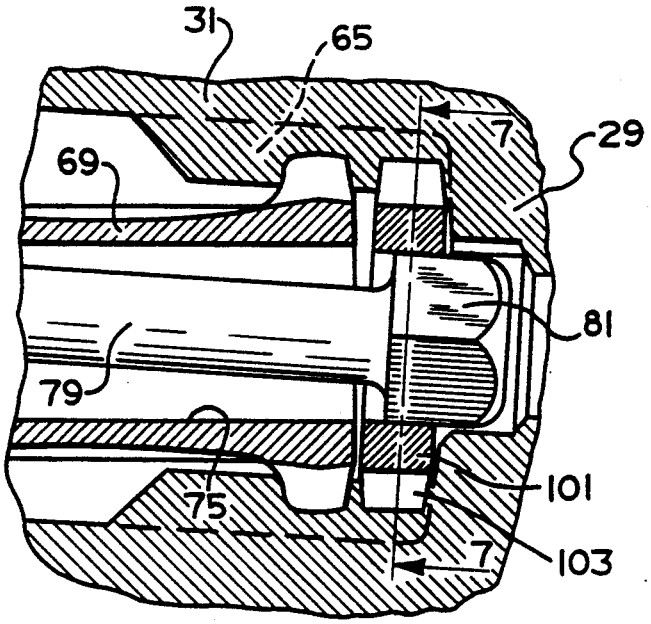
FIG. 6 is a fragmentary, axial cross-section, generally similar to FIG. 4, illustrating an alternative embodiment of the present invention.
Figure 7:
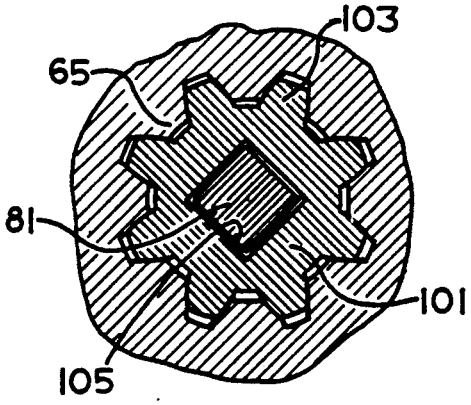
FIG. 7 is a transverse cross-section, taken on line 7—7 of FIG. 6, and on approximately the same scale.

Referring now to FIGS. 6 and 7, an alternative embodiment of the present invention will be described, in which the same or similar elements will bear the same reference numerals as in the FIG. 4 embodiment, and added elements will bear reference numerals in excess of "100". The purpose of the embodiments of FIGS. 6 and 7 is to avoid the necessity of having to provide within the shaft 29 a square opening to receive the shaft end 81, wherein the square opening is as accurate as is required for proper timing. Instead, there is provided an insert member 101, which includes a plurality of external splines 103, disposed in fairly close-fitting, splined engagement with the internal splines 65 defined by the cylindrical portion 31. The insert member 101 defines a square opening 105, which can be more easily produced to the accuracy required in view of the relatively short axial length of the member 101, and the fact that the opening 105 is not "blind" as is the opening 83 of the FIG. 4 embodiment.

Figure 8:
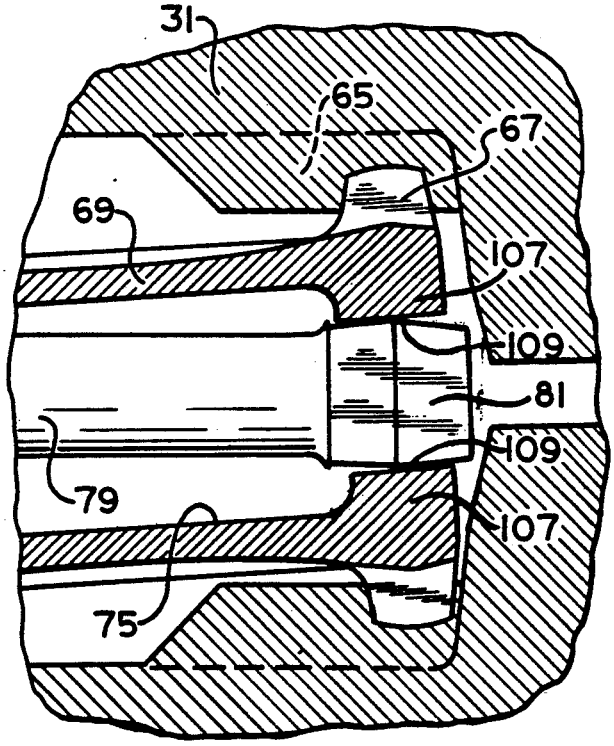
FIG. 8 is a further enlarged, fragmentary, axial cross-section, similar to FIG. 6, illustrating another alternative embodiment of the present invention.

Referring now to FIG. 8, there is illustrated yet another alternative embodiment of the invention. The embodiment of FIG. 8 differs somewhat, in a conceptual sense, from the embodiments of FIGS. 4 and 6, in that the shaft end 81 of the valve drive shaft 79 is not received within the output shaft 29, but instead, is received within the forward end of the main drive shaft 69, which engages in only rotational motion. In the FIG. 8 embodiment, the main drive shaft 69 defines a plurality of internal projections 107, which co-operate to define a square opening, within which is received the shaft end 81 of the valve drive shaft 79. The shaft end 81, in the FIG. 8 embodiment, still has a generally square cross-section, but each of the four sides defines a peak 109, the four peaks 109 co-operating to define a square which is closely fit within the square defined by the projections 107. It will be appreciated by those skilled in the art that the embodiment of FIG. 8 may be especially advantageous in devices having insufficient space, in an axial direction, for the opening 83 of the FIG. 4 embodiment, or for the insert member 101 of the FIG. 6 embodiment.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A rotary fluid pressure device of the type including housing means defining fluid inlet means and fluid outlet means, fluid energy translating displacement means associated with said housing means and including an internally-toothed ring member and an externally-toothed star member eccentrically disposed within said ring member, said star member having orbital and rotational movement relative to said ring member, the teeth of said ring and star members inter-engaging to define expanding and contracting fluid volume chambers in response to said orbital and rotational movement; valve means cooperating with said housing means to provide fluid communication between said fluid inlet means and said expanding fluid volume chambers, and between said contracting fluid volume chambers and said fluid outlet means; input-output shaft means and means for transmitting said rotational movement of said star member to said input-output shaft means; said valve means comprising a valve member adapted to be rotated at the speed of rotation of said star member and being disposed on the side of said displacement means opposite said input-output shaft means; characterized by:

(a) said means for transmitting said rotational movement of said star member comprising an elongated, universal shaft operable to transmit said orbital and rotational movement of said star member into rotational movement of said input-output shaft means, said universal shaft being hollow over substantially its entire axial length; and (b) a valve drive shaft being located at least partially within, and extending axially through, said hollow universal shaft, said valve drive shaft including a valve end in engagement with said valve member and a shaft end operable to transmit purely rotational motion of one of said input-output shaft means and said hollow universal shaft, to transmit said rotational motion into rotation of said valve member.

2. A rotary fluid pressure device as claimed in claim 1, characterized by said valve member comprising a spool valve member defining valving passages on an outer cylindrical surface thereof.

3. A rotary fluid pressure device as claimed in claim 1, characterized by said valve member being disposed immediately axially adjacent said displacement means.

4. A rotary fluid pressure device as claimed in claim 3, characterized by said valve member being relatively solid, whereby said valve member is able to withstand the force of a predetermined fluid pressure, without substantial radial collapse of said valve member.

5. A rotary fluid pressure device as claimed in claim 3, characterized by said valve member defining inlet valving passages and outlet valving passages, said inlet and outlet valving passages being arranged in an alternating, interdigitated pattern about an outer cylindrical surface.

6. A rotary fluid pressure device as claimed in claim 1, characterized by said elongated hollow universal shaft defining a first set of external splines in engagement with a mating set of internal splines defined by said star member, and a second set of external splines in engagement with a mating set of internal splines defined by said input-output shaft means.

7. A rotary fluid pressure device as claimed in claim 1, characterized by said valve member defining an opening adapted to receive said valve end of said valve drive shaft, and said input-output shaft means defining an opening adapted to receive said shaft end of said valve drive shaft.

8. A rotary fluid pressure device as claimed in claim 7, characterized by said valve end being closely fitted within said opening of said valve member, and said shaft end being closely fitted within said opening of said input-output shaft means, whereby one revolution of said input-output shaft means results in substantially one revolution of said valve member.

9. A rotary fluid pressure device as claimed in claim 8, characterized by said valve end and said shaft end being substantially identical in transverse cross-section, whereby said valve drive shaft may be inserted reversibly within said openings.

10. A rotary fluid pressure device as claimed in claim 1, characterized by said input-output shaft means defining an axis of rotation and said valve member defining an axis of rotation, said axes of rotation being coincident, said valve drive shaft defining an axis of rotation substantially coincident with said axes of rotation of said input-output shaft means and said valve member.

11. A rotary fluid pressure device as claimed in claim 1, characterized by said valve member defining an opening adapted to receive said valve end of said valve drive shaft, and said input-output shaft means receiving an insert member fixed for rotation with said input-output shaft means, said member defining an opening adapted to receive said shaft end of said valve drive shaft.

12. A rotary fluid pressure device as claimed in claim 11, characterized by said elongated hollow universal shaft, defining a set of external splines in engagement with a mating set of internal splines defined by said input-output shaft means, said insert member including a set of external splines in splined engagement with said internal splines defined by said input-output shaft means.

13. A rotary fluid pressure device as claimed in claim 1, characterized by said elongated, hollow universal shaft, including a portion having purely rotational motion, said shaft end of said valve drive shaft including means defining a portion adapted to be received within said universal shaft portion having purely rotational motion, to transmit said rotational motion of said universal shaft into rotation of said valve member.

14. A rotary fluid pressure device as claimed in claim 13, characterized by said elongated, hollow universal shaft defining a bore and further defining internal projections extending radially inwardly from said bore, said shaft end defining peaks, which cooperate to define at least a portion of a square adapted to be received by said projections of said hollow universal shaft.

15. A rotary fluid pressure device of the type including housing means defining fluid inlet means and fluid outlet means, fluid energy translating displacement means associated with said housing means and including an internally-toothed ring member and an externally-toothed star member eccentrically disposed within said ring member, said star member having orbital and rotational movement relative to said ring member, the teeth of said ring and star members inter-engaging to define expanding and contracting fluid volume chambers in response to said orbital and rotational movement; valve means cooperating with said housing means to provide fluid communication between said fluid inlet means and said expanding fluid volume chambers, and between said contracting fluid volume chambers and said fluid outlet means; input-output shaft means and means for transmitting said rotational movement of said star member to said input-output shaft means; said valve means comprising a valve member adapted to be rotated at the speed of rotation of said star member and being disposed on the side of said displacement means opposite said input-output shaft means; characterized by:

(a) said means for transmitting said rotational movement of said star member comprising an elongated, hollow, universal shaft operable to transmit said orbital and rotational movement of said star member into rotational movement of said input-output shaft means;

(b) a valve drive shaft being located at least partially within, and extending axially through, said hollow universal shaft, said valve drive shaft including a valve end in engagement with said valve member, and a shaft end operable to transmit purely rotational motion of one of said input-output shaft means and said hollow universal shaft, thereby to transmit said rotational motion into rotation of said valve member; and (c) said input-output shaft means defining an axis of rotation and said valve member defining an axis of rotation, said axes of rotation being coincident, and said valve drive shaft defining an axis of rotation substantially coincident with said axes of rotation of said input-output shaft means and said valve member.

* * * * *